United States Patent [19]

Raech, Jr. et al.

[11] 4,430,941

[45] Feb. 14, 1984

[54] PROJECTILE WITH SUPPORTED MISSILES

[75] Inventors: Harry Raech, Jr., San Jose; Donald R. Kennedy, Los Altos, both of Calif.

[73] Assignee: FMC Corporation, Chicago, Ill.

[21] Appl. No.: 741,148

[22] Filed: May 27, 1968

[51] Int. Cl.[3] ..... F42B 13/50

[52] U.S. Cl. ..... 102/496; 102/494; 102/501; 102/703

[58] Field of Search ..... 102/7.2, 38, 42, 93, 102/92.2, 63, 90, 389, 394, 489, 455, 491, 494, 496, 501, 703; 89/1

[56] References Cited

U.S. PATENT DOCUMENTS

| | | | |
|---|---|---|---|
| 1,305,967 | 6/1919 | Hawks | 102/63 |
| 3,033,116 | 5/1962 | Critcher et al. | 102/93 |
| 3,092,026 | 6/1963 | Williams et al. | 102/42 |
| 3,216,321 | 11/1965 | Null et al. | 89/1 |
| 3,318,241 | 5/1967 | Gould | 102/7.2 |
| 3,422,761 | 1/1969 | Whitmore | 102/42 |

*Primary Examiner*—Harold J. Tudor

*Attorney, Agent, or Firm*—Henry M. Stanley; Richard B. Megley

[57] ABSTRACT

A projectile is shown which has stacked bays to receive packs of flechettes. The flechettes of each pack are bound together and supported by a frangible matrix. The matrix consists of small smooth glass spheres bound together and to the flechettes by a resin. The matrix prevents the flechettes from becoming damaged during acceleration of the projectile.

15 Claims, 8 Drawing Figures

FIG_1
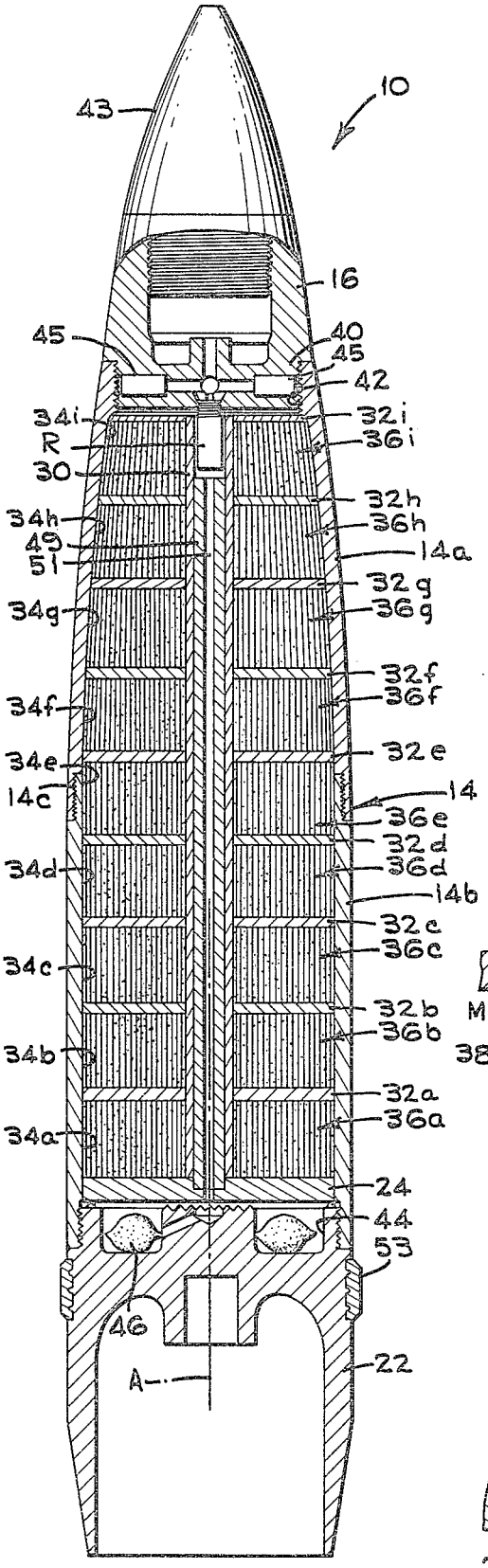
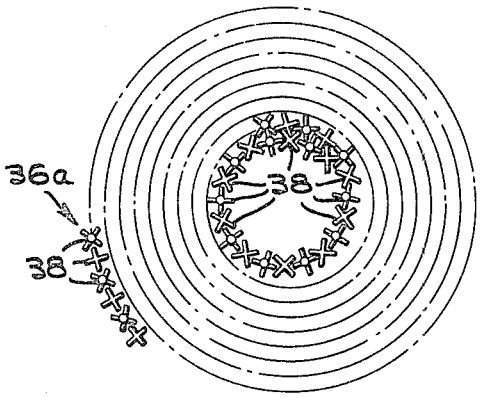
FIG_3
FIG_2
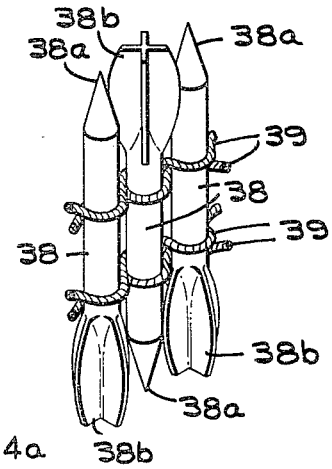
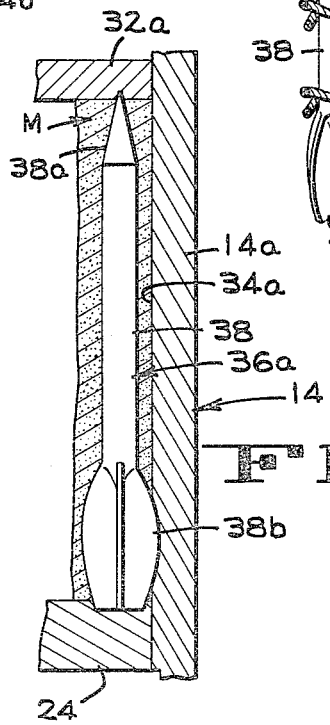
FIG_4

FIG_7
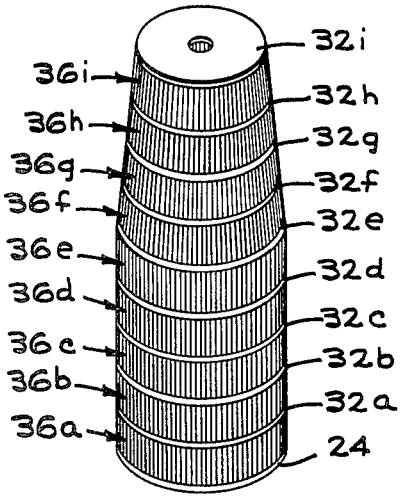
FIG_6
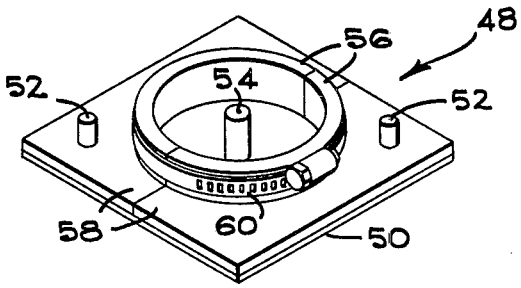
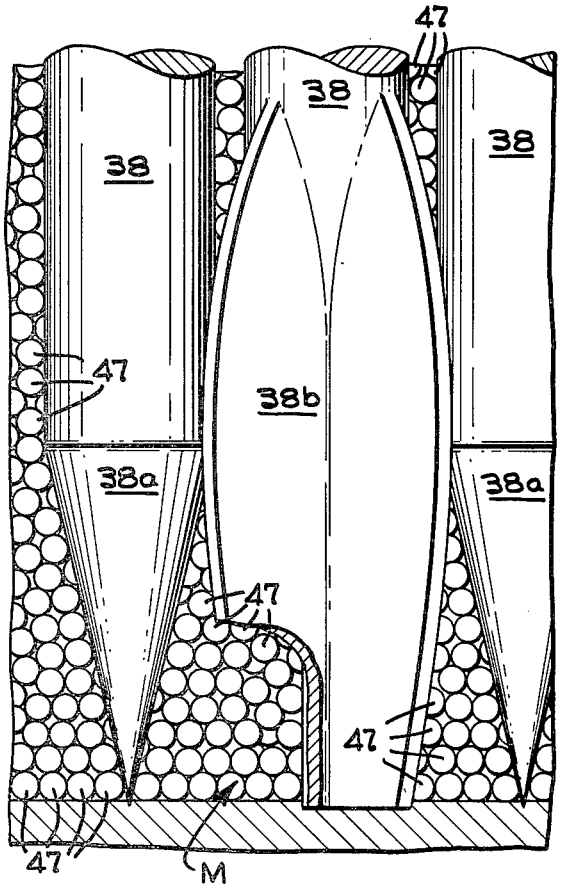
FIG_4
FIG_5
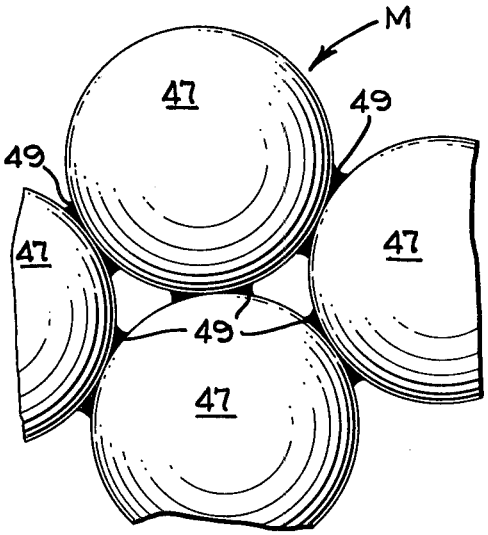

PROJECTILE WITH SUPPORTED MISSILES

BACKGROUND OF THE INVENTION

In one type of projectile, such as an artillery projectile, a plurality of small missiles, such as pointed flechettes, are carried for dispersion when the projectile functions at the target area. The cost and complexity of a projectile of this type is high because of the structure which must be provided to protect the fletchettes from damage during acceleration of the projectile.

A typical projectile constructed to carry flechettes to the target has a plurality of axial spaced compartments, or bays, to receive the flechettes, each bay defined by an inner support core, an outer support ring, and steel end plates. These structural members, which fit inside the projectile, serve to receive the axial acceleration forces so that these forces are not transmitted through the flechettes. These members are also interlocked to transfer angular accelerations to the flechettes in each compartment. As the projectile accelerates upon firing, the inertia of the flechettes in one compartment creates a force on the end, or bottom, steel disc of that bay. The steel disc, which constitutes the top disc of the next lower bay, is supported by the inner core and outer ring of that bay so that force exerted by the flechettes in the upper bay is transmitted to the inner core and the outer ring of the lower bay, rather than to the flechettes in the lower bay.

The inner cores and outer ring, which must be strong enough to support the flechettes and all structural members above the compartment, not only add to the cost of the projectile, but greatly reduce the number of flechettes which can be carried by the projectile. Moreover, the dissipation of energy in fracturing the outer ring on release of the flechettes from the projectile reduces the extent of dispersion of the flechettes to reduce the effectiveness on the target.

SUMMARY OF THE INVENTION

In the present invention there is provided a projectile, such as an artillery projectile, in which missiles, such as flechettes, are protected from damage by the acceleration forces without supporting inner cores or outer rings to receive these forces. In brief, in the preferred form of the invention, a plurality of flechettes, with finely divided smooth particulates such as small glass spheres filling the interstitial voids, are molded with a frangible resin binder into an annular pack to fit over a non-supporting core in the projectile. The packs of flechettes are stacked in the projectile body, or casing, with aluminum discs between the packs, and the separated, stacked, packs are received in the projectile.

On acceleration of the projectile, the acceleration forces exerted on the flechettes are transmitted to the glass spheres which have high compressive strength. The force on each pack of flechettes is transmitted through the aluminum disc to the next pack of flechettes. Since each pack of flechettes, however, is bound with the closely spaced glass spheres, the acceleration load is shared both by the glass spheres of a pack and the flechettes.

When the fuze functions at the target, the constraining casing is either removed or the payload is otherwise expelled. The flechettes are released and laterally dispersed as a result of the centrifugal force on the projectile. The molded pack of flechettes is readily frangible so that the flechettes burst out of the mold without significant loss of energy.

It is therefore one object of the present invention to provide a simpler, less expensive, projectile to carry flechettes to a target area. It is another object of the present invention to support flechettes in a projectile without requiring support of inner cores and outer rings. It is still another object of the present invention to provide, in a projectile carrying flechettes, a matrix to support the flechettes.

BRIEF DESCRIPTION OF THE DRAWINGS

FIG. 1 is a cross-sectional view in elevation of an artillery projectile constructed in accordance with the present invention;

FIG. 2 is a view in perspective of three of the flechettes bound together by thread;

FIG. 3 is a plan fragmentary view of the flechettes as received in a bay of the projectile;

FIG. 4 is an enlarged view of flechettes received in the supporting matrix;

FIG. 5 is an enlarged view of the glass spheres of the matrix bound together by resin;

FIG. 6 is a view of the mold in which the flechettes are received for molding into an annular pack;

FIG. 7 is a view in perspective of a stack of molded packs or flechettes ready for insertion into a projectile; and FIG. 8 shows a flechette pressed into the projectile and into the bay end plates.

DESCRIPTION OF THE PREFERRED EMBODIMENT

There is shown in FIG. 1 a typical embodiment of the invention in the form of an artillery projectile 10 constructed in accordance with the present invention. The projectile body has a base 22, a two piece aluminum casing 14, and a nose fuze adaptor 16. The casing 14 comprises two elements, an ogival section **14*a* and a cylindrical section 14*b* joined by threads 14*c***.

The rear end of casing 14 is internally threaded to engage with external threads on the base 22. When the casing is threaded on the base, on aluminum piston 24 in the casing abuts against base 22. Piston 24 engages a hardened knurled pattern on the forward surfaces of the base 22 so that rotation imparted to the projectile by rifling of the gun tube when fired, will be transmitted to the internal components of casing 14. A hollow flash tube 30 extends through the casing on the central axis A of the projectile body. A plurality of annular aluminum discs, **32*a*, 32*b*, 32*c*, 32*d*, 32*e*, 32*f*, 32*g*, 32*h*, and 32*i* received on the tube, and axially spaced thereon, divide the interior of the projectile body into annular compartments, or bays, 34*a*, 34*b*, 34*c*, 34*d*, 34*e*, 34*f*, 34*g*, 34*h*, and 34*i***.

Annular packs, or rolls, **36*a*, 36*b*, 36*c*, 36*d*, 36*e*, 36*f*, 36*g*, 36*h*, and 36*i* of small missiles, or flechettes, 38, which constitute the payload of the projectile, are carried, respectively, in the bays, one pack for each bay. As shown best in FIG. 2, each flechette 38 has a conical nose 38*a* at one end and fins 38*b*, typically in cruciform configuration, at the opposite end. The flechettes of a pack are typically bound together by threads 39, every other flechette typically facing one direction and alternate flechettes facing the opposite direction. Each pack of flechettes, as, for example, pack 36*a* shown in FIG. 3, consists of a single layer of upstanding flechettes, wound in a helix to fit within one annular bay, such as bay 34***a*.

The nose fuze adapter 16 has a threaded end 40 which is engaged in a threaded bore 42 in the forward end of casing 14. The output of a fuze 43 initiates four radially oriented detonators 45 to sever the ogival part of the casing at the forward threaded joint. As a result of air pressure and centrifugal force the forward casing tears into four segments to the joint at the mid point of the casing, thus freeing the forward packs of flechettes which are then disbursed by centrifugal force. A pyrotechnic relay R secured in the nose fuze adaptor and received in tube 30 communicates with the interior of tube 30, which as a core member 49 with a flash passage 51 extending therethrough. The passage 51, in turn, communicates with the annular pocket 44 in the base 22. Powder in relay R is caused to be ignited by the nose fuze when the shell reaches the target area to initiate a propelling charge 46 in recess 44. The burning of charge 46 propels the piston 24 and the remaining packs of flechettes out of the cylindrical after portion of the casing. Centrifugal force then disburses the flechettes when the flechettes are freed of the constraint of the casing.

A rotating band 53, tightly secured on base 22, is received in rifling grooves in the gun tube to impart rotation to the projectile when the projectile is fired out of the gun tube. During acceleration of the artillery projectile in the gun tube, the flechettes are subjected to large axial and angular acceleration forces which, in some conventional projectiles, are transmitted to heavy rings surrounding each compartment. These rings not only add signficantly to the cost and weight of the projectile, but materially reduce the size of the flechette bays to reduce the number of flechettes carried.

In order to support the flechettes without using heavy rings, finely divided smooth particulates 47, which, preferably are glass spheres, fill the interstitial space between the flechettes in each bay, as shown in FIG. 4. The glass spheres may typically be GLASSHOT microspheres, size MS-M, produced by CATAPHOTE Corporation, Jackson, Miss. Preferably, the spheres are lightly adhesively bonded together, as shown at 49 in FIG. 5, with the roll of flechettes, into a pack conforming in size and shape to the interior of a bay. The flechettes are thus bound together into a frangible unit to facilitate handling but to permit ready separation of the flechettes when released from the casing 14. Satisfactory support has been provided by spheres between 0.003 inches and 0.016 inches in diameter, but maximum support was provided by spheres of nominally 0.006 inches in diameter.

Each pack of flechettes is prepared in a mold, one of which 48 is shown in FIG. 6. The mold typically has a base plate 50 with two upstanding locating pins 52 and with a central upstanding stud 54. Two semi-circular ring members 56 are secured, respectively, in semi-circular edges of two mounting plates 58 which are received on the two pins 52. The two semi-circular ring members are fastened together by a band 60. There is a different sized mold for the different sized forward bays 34*f*, 34*g*, 34*h*, and 34*i* in the projectile casing 14. One mold, or molds of equal size, can be used to prepare the packs for the rear, equal sized compartments 34*a*, 34*b*, 34*c*, 34*d*, and 34*e*. The inner diameter of the ring formed by members 56 of the mold equals the inner diameter of the casing 14 at the bay for which the particular pack of flechettes is being prepared. The diameter of the stud 54 equals the diameter of the hollow tube 30.

There is prepared a binder solution of the following composition (given in parts by weight): acetone, 100; diallyl orthophthalate prepolymer, 40; diallyl phthalate monomer, 2; t-butyl perbenzoate, 0.4; and t-butyl catechol, 500 parts per million. The glass spheres are immersed in this solution until wetted, at which time the solution is drained off. The spheres are dried at room temperature, forming a hard cake which is broken up into fragments of marble size. The fragments are further reduced with a ball mill using ceramic balls to pass through a No. 48 mesh screen. Other resin binders, such as phenolic, urea formaldehyde, or melamine may be used.

The mold is coated with a silicone release agent. The mold is then packed with a spiral coiled roll of sewed, alternately opposed, flechettes. The flechettes should fill the mold but not be a press fit. The mold is placed on a vibrating table and the interstices between the flechettes are filled with the coated glass spheres which have passed through a No. 48 mesh screen. The mold and contents are placed in a 350° F. oven for a sufficient time for the compound to be at 310° F. for five minutes, to form a matrix M which supports and holds the flechettes together as indicated in FIGS. 4 and 5. The cured matrix is removed from the mold which, if necessary, is cooled before removal of the matrix. If the pack is to be subjected to extensive handling, the matrix is further sprayed with a light coating of pigmented lacquer to prevent abrasion and loss of the glass spheres.

As shown in FIG. 7, the packs of flechettes are stacked over tube 30, with aluminum discs separating the packs, in the same order they occupy in the casing. The stack is then inserted into casing 14, before the casing assembly is secured to the base 22. The stack is then pressed rearward to effect engagement between the piston, support discs, and flechettes to insure transmission of angular acceleration through the stack.

With the flechettes in the bays embedded in a frangible matrix containing glass spheres, the weight of the flechettes during gun launch acceleration (which may be many thousands of times the normal weight of the flechettes) is largely borne by the glass spheres. The acceleration force is passed from bay to bay through the matrices and the aluminum discs so that the matrices in the rear compartments are subjected to many times the force of the matrices in the forward compartments. The glass spheres have high compressive strength and prevent damage to the tips and fins of the flechettes by limiting the extent of radial or axial movement of the flechettes.

It will be noted, from FIG. 8, that the flechettes are arrayed parallel to the central axis A of the projectile and normal to the aluminum separating discs between compartments. The fins and noses of the steel flechettes, which are harder than the aluminum discs and aluminum casing, penetrate slightly into the forward and rear end aluminum discs of the compartment, and the fins of the outer row flechettes, under contrifugal force generated by rotation of the projectile, penetrate slightly into the casing 14. Thus, the flechettes rotate with the projectile and the matrix is prevented from rotation relative to the compartment. Where exceptionally high angular accelerations are experienced, physical engagement of the aluminum support discs with the internal surface of the casing may be required to ensure that the spin of the projectile is imparted to all packs. This may be accomplished by adhesive bonding, or by some form of simple spline on the discs and casing wall.

Because the flechettes are harder than the metal with which they come in contact, the flechette tips are not blunted. At the same time, the matrix supports the flechettes, protecting the flechettes from the high acceleration forces. Moreover, the matrix prevents excessive movement of the flechettes within the compartment, but the matrix is readily frangible so that, upon removal of the casing restraint, the flechettes will be released without loss of significant energy, for effective dispersal.

The payload supporting method described herein can be utilized, with variations, in canister shell, rocket warheads, and gun projectiles of all types and carrying discrete component fillers including high explosive or pyrotechnic submissiles, and all shapes of inert submissiles. The protecting matrix supports the payload components equally on all surfaces against single or multiple-acting, high-intensity accelerations including projectile firing, explosive dissemination, and target or earth impact. The supporting matrix is characterized by an exceptionally high compressive strength but low tensile strength so as to readily free the object being protected when constraints are removed.

The invention is applicable to any device, commercial or military, requiring component protection when subjected to severe acceleration or shock environments.

Although the best mode contemplated for carrying out the present invention has been herein shown and described, it will be apparent that modifications and variations may be made without departing from what is regarded to be the subject matter of the invention as set forth in the appended claims.

Having completed a detailed description of the invention so that those skilled in the art could practice the same, we claim:

1. A projectile having a compartment therein to receive missiles, a plurality of missiles received in said compartment, and a plurality of finely divided smooth particulates in the form of glass spheres received in said compartment with the missiles to support the missiles during acceleration of the projectile.

2. The article of claim 1 in which said glass spheres are between 0.003 inches and 0.016 inches in diameter.

3. The article of claim 1 in which said glass spheres are 0.006 inches in diameter.

4. The article of claim 1 in which said glass spheres are bound together with the missiles by means of a frangible binder.

5. The article of claim 2 in which said glass spheres and missiles are bound together with a frangible resin binder into a unit conforming in size and shape to the interior of the compartment.

6. A projectile having a plurality of compartments therein to receive flechettes, a plurality of flechettes received in each compartment, and a plurality of finely divided smooth particulates in the form of glass spheres received in said compartments with the flechettes to support the flechettes during acceleration of the shell.

7. The article of claim 6 in which said glass spheres are between 0.003 inches and 0.016 inches in diameter.

8. The article of claim 6 in which said glass spheres are bound together with the flechettes by means of a frangible binder.

9. The article of claim 6 in which said glass spheres and flechettes are bound together to form packs having sizes and shapes to conform to the interior of the casing.

10. The article of claim 6 in which the compartments are axially arrayed along the projectile and in which aluminum discs separate the compartments.

11. The article of claim 10 in which the flechettes are molded into packs containing the glass spheres for receipt into said compartments with the flechettes normal to said separating discs.

12. An artillery projectile having a central axis and having an elongated, axially extending, casing, said casing having axially spaced discs therein to divide the interior of the casing into a plurality of stacked bays, a plurality of axially aligned flechettes received in each bay, said flechettes frangibly bound into packs with a plurality of glass spheres bound into each pack in the interstitial void between flechettes to support the flechettes during acceleration of the projectile.

13. The projectiles of claim 12 in which said packs are molded with a frangible binder.

14. The projectile of claim 12 in which said axially spaced discs are made of a softer material than the flechettes.

15. The projectile of claim 14 in which said glass spheres are of a diameter between 0.016 inches and 0.003 inches.

* * * * *